United States Patent [19]

Calsson et al.

[11] Patent Number: 4,915,756

[45] Date of Patent: Apr. 10, 1990

[54] PYROTECHNICAL DELAY CHARGE

[75] Inventors: Staffan Calsson; Tore Boberg; Conny Sjöqvist, all of Karlskoga, Sweden

[73] Assignee: Aktiebolaget Bofors, Karlskoga, Sweden

[21] Appl. No.: 248,802

[22] Filed: Sep. 26, 1988

[30] Foreign Application Priority Data

Sep. 29, 1987 [SE] Sweden ..... 8703743-8

[51] Int. Cl.[4] ..... C06B 45/10

[52] U.S. Cl. ..... 149/19.9; 149/19.91; 149/22; 149/37; 149/44

[58] Field of Search ..... 149/19.9, 19.71, 22, 149/37, 44

[56] References Cited

U.S. PATENT DOCUMENTS

| | | | |
|---|---|---|---|
| 3,883,373 | 5/1975 | Sidebottom | 149/6 |
| 4,237,787 | 12/1980 | Wacula | 149/44 |
| 4,374,686 | 2/1983 | Davitt et al. | 149/37 |
| 4,419,153 | 12/1983 | Boberg | 149/22 |
| 4,447,278 | 5/1984 | Sédat | 149/19.92 |
| 4,508,580 | 4/1985 | Klöber | 149/19.91 |
| 4,608,102 | 8/1986 | Krampen et al. | 149/37 |

*Primary Examiner*—Edward A. Miller

*Attorney, Agent, or Firm*—Pollock, Vande Sande & Priddy

[57] ABSTRACT

The disclosure relates to a pyrotechnical delay charge which may be mixed in water, comprising 4–17% by weight of boron (B)

0–17% by weight of zirconium (Zr), titanium (Ti) and-/or zirconium-nickel alloys 10–35% by weight of titanium dioxide ($TiO_2$)

40–65% by weight of tin dioxide ($SnO_2$), and 0.5–10% by weight of chlorinated rubber and possibly up to 3% by weight of an aqueous dispersible acrylate binder.

The chlorinated rubber component is a particularly characteristic feature of this pyrotechnical charge and is included as a phlegmatization and burning rate reducing agent.

8 Claims, No Drawings

PYROTECHNICAL DELAY CHARGE

TECHNICAL FIELD

The present invention relates to a pyrotechnical delay charge whose rate of burning may, within the percentage concentrations characteristic of the invention, be varied within such wide limits as 3–20 mm/sec.

The most manifest advantage inherent in the pyrotechnical charge according to the present invention is that it solely contains such active components as themselves do not react with water and as are sufficiently sparingly soluble in water to allow a mixture and granulation in water. After the final mixing, which thus takes place in water and which can also include a necessary pulverization or grinding of the included components, these form after possible dewatering a viscous paste which is dried and granulated and is thereafter ready for use either directly or after pressing into united charges or pellets of the desired size and shape.

Since the delay charge according to the present invention consists of a physical mixture which may be completed wholly in aqueous mixture, it has become possible virtually entirely to eliminate the explosion risks in the production process itself. This, in turn, has made it possible to increase considerably the charge sizes which obviously results in increased capacity and thus a lower price for the end product.

As a rule, prior-art delay charges have always contained some water-soluble or water-reacting component which renders an aqueous mixture thereof impossible.

On the other hand, there has long been a clearly expressed desire within this art to be able to produce delay charges which are miscible in water and display a sufficiently high performance standard.

Tests carried out have shown that the delay charge according to the present invention more than satisfies those requirements which may reasonably be placed on a product of this type in respect of both its function, its temperature insensitivity and its storage life.

The pyrotechnical delay charge according to the present invention will assume the desired rate of burning of 3–20 mm/sec. by a combination of 4–17% by weight of boron (B), 4–17% by weight of zirconium (Zr), titanium (Ti) and/or a zirconium-nickel alloy, 10–35% by weight of titanium dioxide ($TiO_2$), 40–65% by weight of tin dioxide ($SnO_2$), and 0.5–8% by weight of chlorinated rubber. Since, for certain purposes—in particular in respect of pressed charges or pellets it may desirable to provide an improved mechanical strength, a specific binder is also added in these special cases, the binder being in the form of up to 3% by weight of aqueous which the remaining components are mixed. All components, with the exception of the acrylate binder, are included as fine-grained powder. With respect to the chlorinated rubber, a maximum particle size of e.g. approx. 0.3 mm applies.

The acrylate binder must, furthermore, be aqueous dispersed and it may not influence the burning properties of the pyrotechnical charge more than necessary (it cannot be avoided that the binder will reduce the burning rate somewhat), nor may the binder contain components which have not reacted to completion which, in the long term, may influence the storage life of the pyrotechnical charge. We have found acrylic dispersions of anionic active character based on acrylic and metacrylic acid esters with a Tg of approx. 20° C. to be particularly well suited to this purpose.

The fine-grained chlorinated rubber component particularly characteristic of the pyrotechnical charge according to the present invention has made it possible for us to produce slowly burning pyrotechnical charges with relatively high fuel contents. If, instead, attempts are made in accordance with prior-art technology to produce a slowly burning pyrotechnical charge by reducing the included fuel amount, the risk will always be present that the charge extinguishes because of an excessively high external cooling action. We believe that the inception of the present invention entails the elimination of this problem.

The spirit and scope of the present invention has been defined in the appended claims and the invention will now be described in greater detail in conjunction with a number of relevant examples relating to pyrotechnical delay charges which have been mixed in water and thereafter dried and granulated. All charges displayed a fully satisfactory readiness for ignition and their respective burning rates are apparent, together with their compositions, from the table below.

Examples of different rates of burning in different compositions. The changes were compressed in steel cartridges with an inside diameter of 3.5 mm

| | | | | | | | | |
|---|---|---|---|---|---|---|---|---|
| Rates of burning mm/s (in test cylinder) | | 3 | 6 | 7 | 7 | 10 | 20 | 5 |
| % by weight | Boron (B) | 5 | 5 | 7 | 7 | 10 | 15 | 9 |
| | Zirconium (Zr) | 8 | 8 | 8 | 8 | 10 | 15 | — |
| | Titanium dioxide ($TiO_2$) | 27 | 28 | 25 | 20 | 23 | 15 | 29 |
| | Tin dioxide ($SnO_2$) | 54 | 56 | 55 | 57 | 55 | 54 | 59 |
| | Chlorinated rubber | 6 | 3 | 5 | 8 | 2 | 1 | 3 |

What we claim and desire to secure by Letters Patent is:

1. A pyrotechnical delay charge with a rate of burning of 3–20 mm/sec., comprising 4–17% by weight of boron (B)

0–17% by weight of zirconium (Zr), titanium (Ti) and/or zirconium-nickel alloys

10–35% by weight of titanium dioxide ($TiO_2$)

40–65% by weight of tin dioxide ($SnO_2$)

0.5–10% by weight of chlorinated rubber and possibly up to 3% by weight of an aqueous dispersible acrylate binder.

2. The pyrotechnical delay charge as claimed in claim 1 with a burning rate of 3–20 mm/sec comprising 4–17% by weight of boron (B)

4–17% by weight of zirconium (Zr), titanium (Ti) and/or zirconium-nickel alloys

10–35% by weight of titanium dioxide ($TiO_2$) and

40–65% by weight of tin dioxide ($SnO_2$)

0.5–10% by weight of chlorinated rubber and possibly up to 3% by weight of a water dispersable acrylate binder.

3. The pyrotechnical delay charge as claimed in claim 1, with a rate of burning of 5–6 mm/sec., 5–7% by weight of boron (B)

6–10% by weight of zirconium (Zr), titanium (Ti) and/or zirconium-nickel alloys

25–30% by weight of titanium dioxide ($TiO_2$)

50–60% by weight of tin dioxide ($SnO_2$) and

2–5% by weight of chlorinated rubber and possibly up to 3% by weight of the acrylate binder.

4. The pyrotechnical delay charge as claimed in claim 1, with a rate of burning of 10–20 mm/sec., comprising 10–15% by weight of boron (B)

10–15% by weight of zirconium (Zr), titanium (TI) or zirconium-nickel alloys (Zr/Ni)

15–25% by weight of titanium dioxide ($TiO_2$)

50–60% by weight of tin dioxide ($SnO_2$), and 0.5–3.0% by weight of chlorinated rubber and possibly up to 3% by weight of acrylate binder.

5. The pyrotechnical delay charge according to claim 1 wherein the chlorinated rubber included is present in the form of particles with a maximum particle size of 0.3 mm.

6. The pyrotechnical delay charge as claimed in claim 2, with a rate of burning of 5–6 mm/sec., comprising 5–7% by weight of boron (B)

6–10% by weight of zirconium (Zr), titanium (Ti), and/or zirconium-nickel alloys 25–30% by weight of titanium dioxide ($TiO_2$)

50–60% by weight of tin dioxide ($SnO_2$) and

2–5% by weight of chlorinated rubber and possibly up to 3% by weight of the acrylate binder.

7. The pyrotechnical delay charge of claim 2, comprising an acrylate binder and wherein said acrylate binder has anionic active character.

8. The pyrotechnical delay charge of claim 7, wherein said acrylate binder is based on acrylic and methacrylic acid esters with a TG of about 20° C.

* * * * *